US006267145B1

(12) United States Patent
Sun

(10) Patent No.: US 6,267,145 B1
(45) Date of Patent: Jul. 31, 2001

(54) FAUCET ASSEMBLY ADAPTED TO BE MOUNTED ON A STANDARD WATER PIPE OF A PREDETERMINED DIAMETER

(76) Inventor: Tzu-Hsin Sun, Room C, 16F, No. 447, Sec. 3, Wein-Hsin Rd., Taichung City (TW)

( * ) Notice: Subject to any disclaimer, the term of this patent is extended or adjusted under 35 U.S.C. 154(b) by 0 days.

(21) Appl. No.: 09/558,640

(22) Filed: Apr. 26, 2000

(51) Int. Cl.[7] ..... E03C 1/042
(52) U.S. Cl. ..... 137/801; 137/360
(58) Field of Search ..... 137/360, 801

(56) References Cited

U.S. PATENT DOCUMENTS

| | | | | |
|---|---|---|---|---|
| 3,136,570 | * | 6/1964 | Lee | 137/360 |
| 3,371,679 | * | 3/1968 | Minella | 137/360 |
| 3,393,746 | * | 7/1968 | Young | 137/360 |
| 4,084,620 | * | 4/1978 | Bucknell | 137/360 |

* cited by examiner

*Primary Examiner*—Gerald A. Michalsky
(74) *Attorney, Agent, or Firm*—Pitney, Hardin, Kipp & Szuch, LLP

(57) ABSTRACT

A faucet assembly includes a faucet body having a front portion defining a water passage, a water inlet for introducing water into the water passage, a nozzle disposed at a downstream position with respect to the water flow, and a pipe mounting seat disposed at an upstream position and in fluid communication with the water inlet. A coupler pipe is disposed within an intermediate portion of the faucet body, and has a front pipe section that extends into the front portion of the faucet body and that is connected securely to the pipe mounting seat, an externally threaded rear pipe section, and an enlarged middle pipe section between the front and rear pipe sections. An adjustment sleeve member is disposed around the coupler pipe, and has a front part enclosing slidably and sealingly an enlarged middle pipe section of the coupler pipe, a rear part that is coupled with a standard water pipe, and a middle part threadedly engaging the rear pipe section of the coupler pipe such that rotation of the sleeve member with respect to the coupler pipe results in axial movement of the rear part of the adjustment sleeve member in the rear portion of the faucet body.

6 Claims, 10 Drawing Sheets

FAUCET ASSEMBLY ADAPTED TO BE MOUNTED ON A STANDARD WATER PIPE OF A PREDETERMINED DIAMETER

BACKGROUND OF THE INVENTION

1. Field of the Invention

This invention relates to a faucet assembly, more particularly to a faucet assembly that is adapted to be mounted on a standard water pipe and that can be mounted on a selected one of two other standard water pipes of different size or structure by removing one or two parts.

2. Description of the Related Art

Referring to FIGS. 1 and 2, a conventional faucet assembly 10 is shown to be adapted for mounting on an externally threaded standard water pipe 20, and to include a faucet body 11 and a coupler pipe 12.

As illustrated, the faucet body 11 includes a front portion 111 and a rear portion 113. The front portion 111 defines a water passage 100 for flow of water therethrough, and has a water inlet 101 for introducing water into the water passage 100, a nozzle 102 disposed at a downstream position with respect to the water flow for release of water therefrom, and a pipe mounting seat 112 disposed at an upstream position and in fluid communication with the water inlet 101. The coupler pipe 12 has a predetermined length, and is disposed within the rear portion 113 of the faucet body 11. The coupler pipe 12 has a front pipe section 121 extending into the front portion 111 and connected securely to the pipe mounting seat 112, and a rear pipe section 123 formed with an internal thread.

During the construction of a building, the standard water pipe 20 is usually embedded within a cement wall 30 such that only a limited length of the water pipe 20 is exposed outwardly from the wall 30. Prior to mounting the aforesaid faucet assembly 10 on the water pipe 20, the entire length of the coupler pipe 12 is measured, and the rear pipe section 123 thereof is subsequently cut so as to achieve a desired length of the coupler pipe 12 that is adapted to be fastened threadedly on the externally threaded end portion of the water pipe 20. The pipe mounting seat 112 of the faucet body 11 is threaded on the front pipe section 121 of the coupler pipe 12 until the rear portion 113 of the faucet body 11 abuts against the cement wall 30. A relatively high precision is thus needed to cut the coupler pipe 12.

In addition, since there are two standard water pipes 20 of different diameters, the coupler pipe 12 used in one type of faucet assembly can not be applied in the other type of faucet assembly.

Referring to FIGS. 3 and 4, another conventional faucet assembly 10 is shown to be adapted for mounting on a standard water pipe 21 with a non threaded end portion.

As illustrated, since the water pipe 21 has a diameter smaller than that of the water pipe 20 of FIG. 1, a coupling member 13 and a locking bolt 135 are additonally required to establish connection between the coupler pipe 12 and the water pipe 21. The coupling member 13 is sleeved over the non-threaded end portion of the standard water pipe 21, and has an externally threaded front portion 131 that is formed with a threaded radial hole 134, and that is coupled threadedly with the internally threaded end portion 123 of the coupler pipe 12. The bolt 135 is inserted threadedly through the radial hole 134 and presses against the non-threaded end portion of the standard water pipe 21, thereby locking the coupling member 13 on the standard water pipe 21. A seal ring 136 is disposed between the coupling member 13 and the standard water pipe 21 to form a water seal therebetween. The coupler pipe 12 and the faucet body 11 are assembled on the standard water pipe 21 in the above described manner. During mounting of this faucet assembly on the water pipe 21, the same disadvantages as described above are encountered.

SUMMARY OF THE INVENTION

Therefore, the object of this invention is to provide a faucet assembly that is adapted to be easily mounted easily on a standard water pipe.

Accordingly, the faucet assembly of the present invention is adapted to be mounted on a standard water pipe of a predetermined diameter, and includes a faucet body, a coupler pipe, and an adjustment sleeve member. The faucet body includes a front portion, a rear portion and an intermediate portion between the front and rear portions. The front portion defines a water passage for flow of water therethrough, and has a water inlet for introducing water into the water passage, a nozzle disposed at a downstream position with respect to the water flow for release of water therefrom, and a pipe mounting seat disposed at an upstream position and in fluid communication with the water inlet. The coupler pipe is disposed within the intermediate portion of the faucet body, and has a first predetermined length, a front pipe section that extends into the front portion of the faucet body and that is connected securely to the pipe mounting seat, a rear pipe section formed with an external thread, and an enlarged middle pipe section between the front and rear pipe sections. The adjustment sleeve member is disposed around the coupler pipe, and has a second predetermined length longer than the first predetermined length and shorter than a total length of the faucet body. The adjustment sleeve member further has a front part enclosing slidably and sealingly the enlarged middle pipe section of the coupler pipe, a rear part that is adapted to be coupled with the standard water pipe, and a middle part threadedly engaging the rear pipe section of the coupler pipe such that rotation of the sleeve member with respect to the coupler pipe results in axial movement of the rear part of the adjustment sleeve member in the rear portion of the faucet body. Thus, a distal end of the rear portion of the faucet body can be brought to abut against the wall from which the water pipe is exposed, thereby concealing and enclosing the standard water pipe therewithin.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
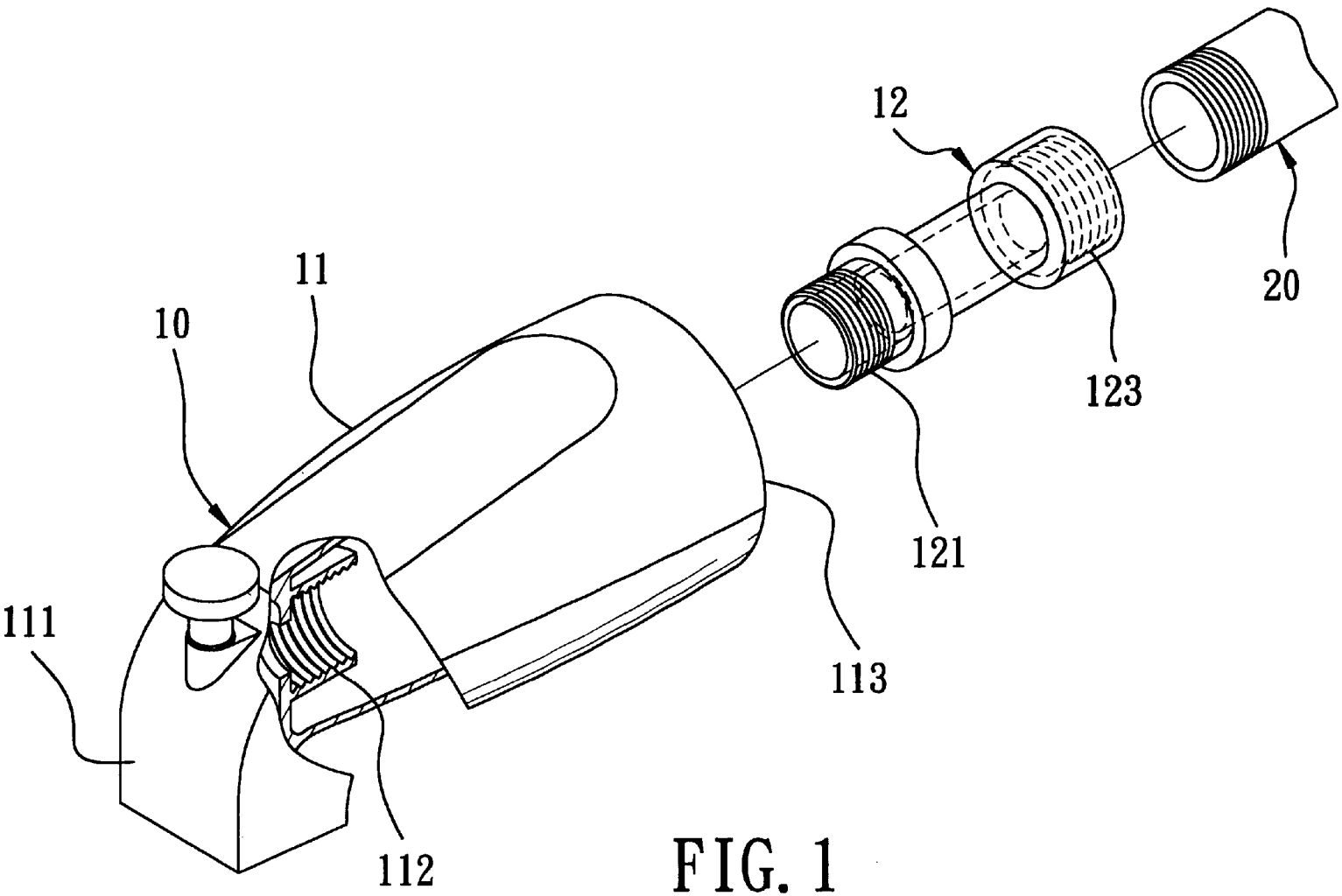
FIG. 1 PRIOR ART
FIG. 1 is an exploded perspective view of a first conventional faucet assembly for mounting on a standard water pipe with an externally threaded end portion.
Figure 2:
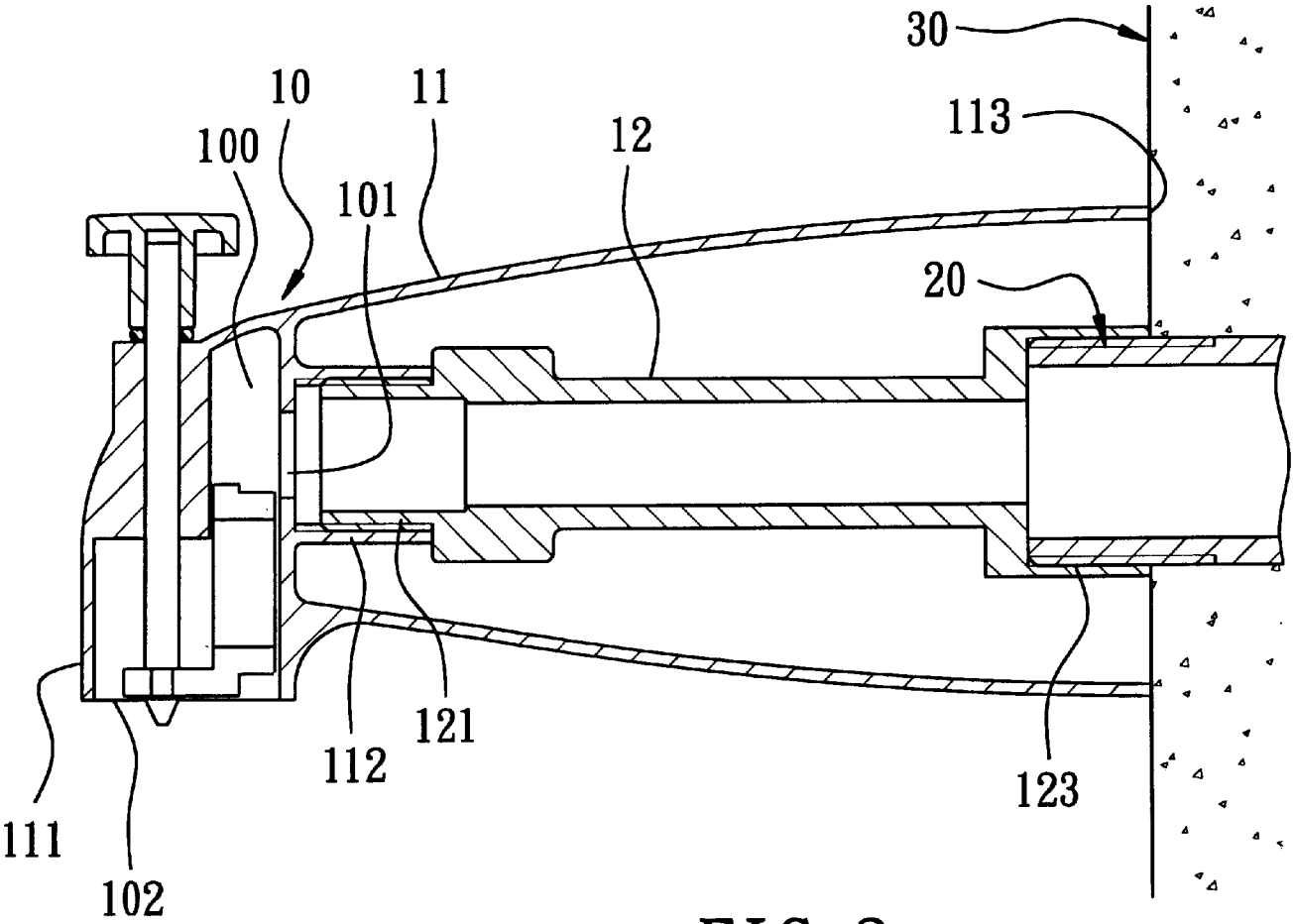
FIG. 2 PRIOR ART
FIG. 2 is a sectional view of the first conventional faucet assembly when mounted on the standard water pipe.
Figure 3:
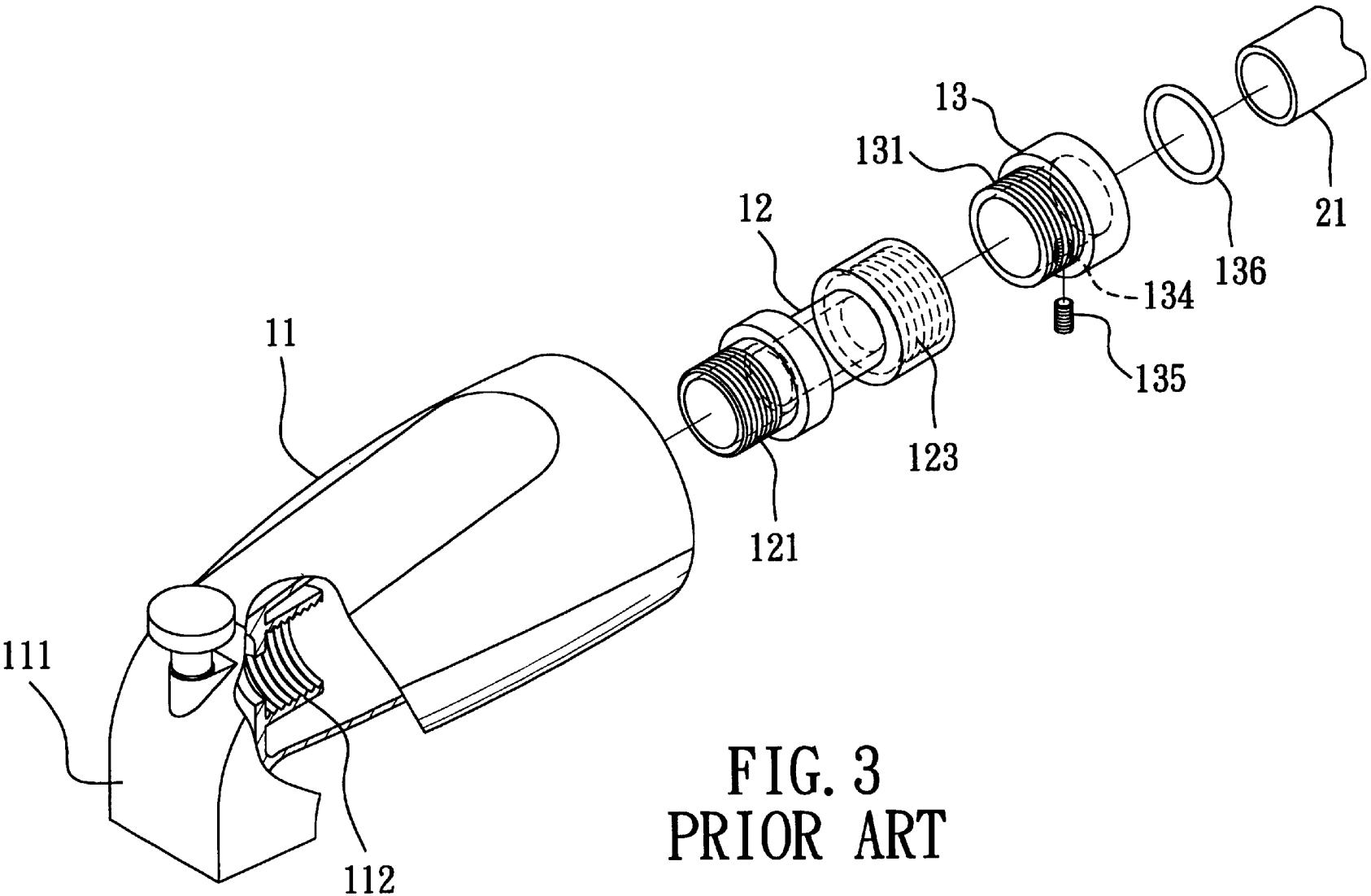
FIG. 3 PRIOR ART
FIG. 3 is an exploded perspective view of a second conventional faucet assembly for mounting on a standard water pipe with a non-externally threaded end portion.
Figure 4:
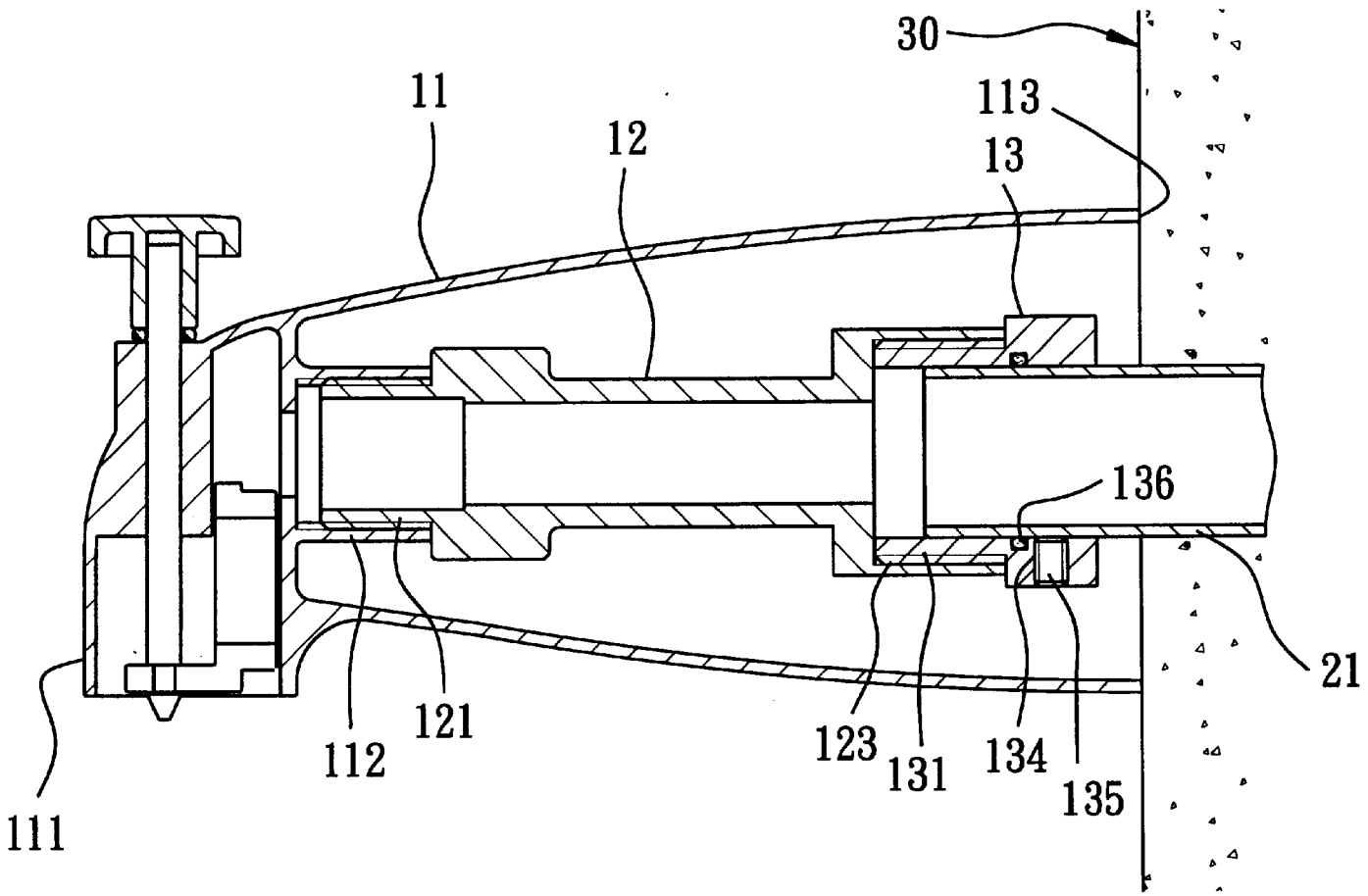
FIG. 4 PRIOR ART
FIG. 4 is a sectional view of the second conventional faucet assembly when mounted on the standard water pipe.
Figure 5:
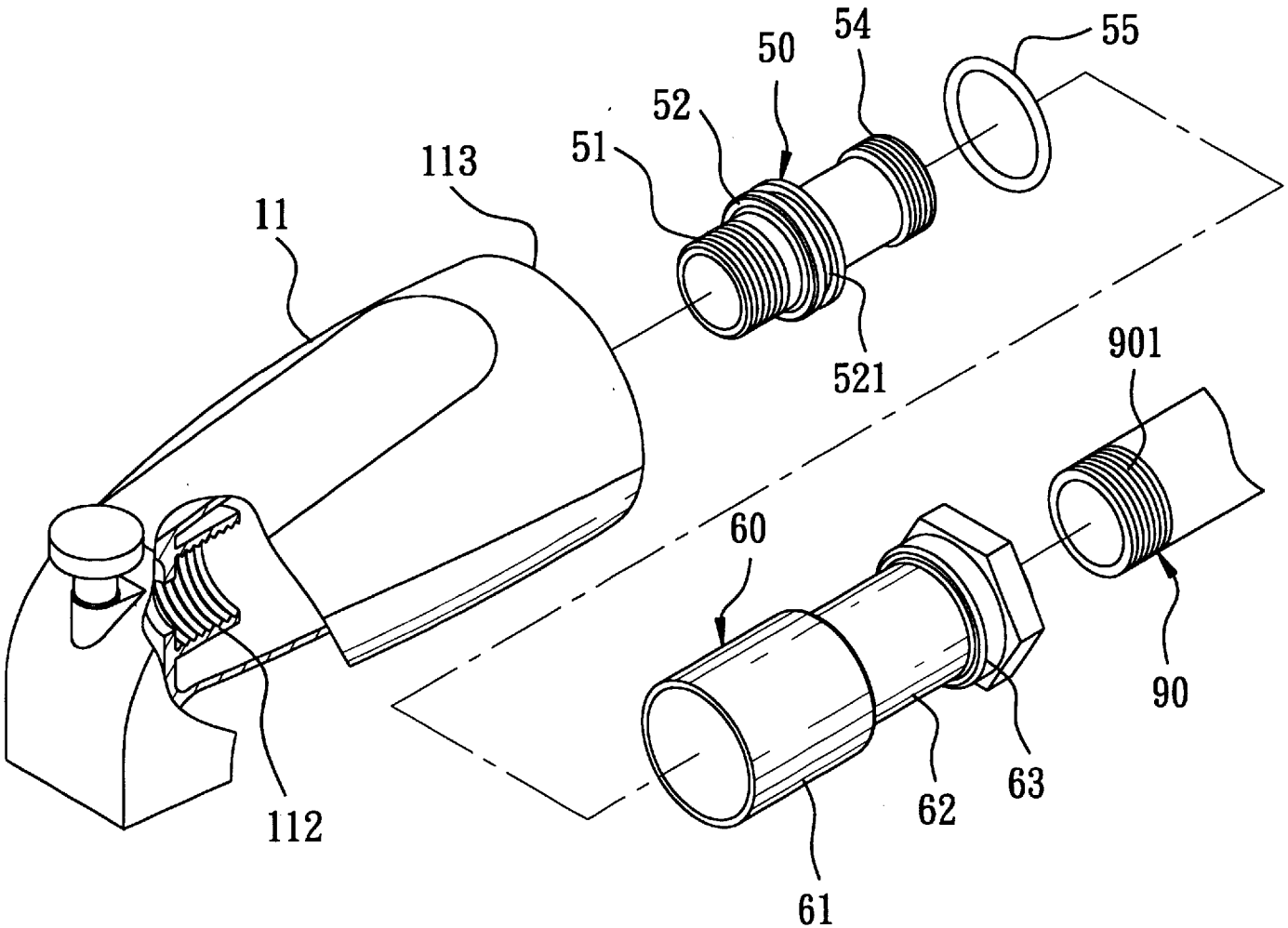
FIG. 5 is an exploded perspective view of the first preferred embodiment of a faucet assembly of the present invention for mounting on a large-diameter standard water pipe with an externally threaded end portion.
Figure 6:
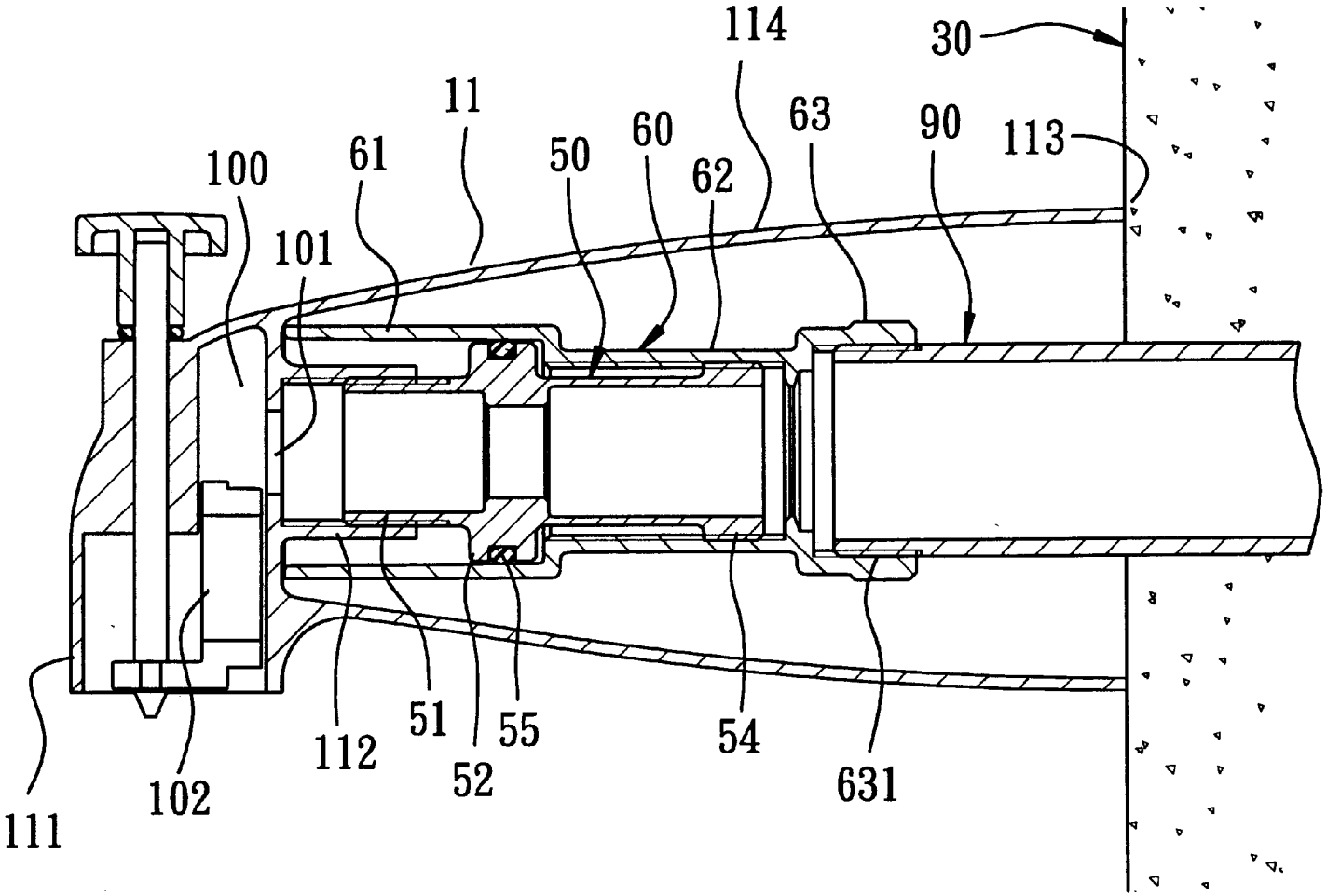
FIG. 6 is a sectional view of the first preferred embodiment when mounted on the threaded end portion of the standard water pipe.

Referring to FIGS. 5 and 6, the first preferred embodiment of a faucet assembly of the present invention is shown to be adapted for mounting on a large-diameter standard water pipe 90 with an externally threaded end portion 901. The first preferred embodiment includes a faucet body 11, a coupler pipe 50, and an adjustment sleeve member 60.

As illustrated, the faucet body 11 includes a front portion 111, a rear portion 113 and an intermediate portion 114 between the front and rear portions 111, 113. The front portion 111 defines a water passage 100 for flow of water therethrough, and has a water inlet 101 for introducing water into the water passage 100, a nozzle 102 disposed at a downstream position with respect to the water flow for release of water therefrom, and a pipe mounting seat 112 disposed at an upstream position and in fluid communication with the water inlet 101.

The coupler pipe 50 is disposed within the intermediate portion 114 of the faucet body 11. The coupler pipe 50 has a first predetermined length, a front pipe section 51 that extends into the front portion 111 of the faucet body 11 and is connected securely to the pipe mounting seat 112, a rear pipe section 54 formed with an external thread, and an enlarged middle pipe section 52 between the front and rear pipe sections 51, 54.

The adjustment sleeve member 60 is disposed around the coupler pipe 50, and has a second predetermined length longer than the first predetermined length and shorter than a total length of the faucet body 11. The adjustment sleeve member 60 has a front part 61 enclosing slidably and sealingly the enlarged middle pipe section 52 of the coupler pipe 50, a rear part 63 with an internally threaded end portion 631 adapted to be coupled threadedly on the threaded end portion 901 of the standard water pipe 90, and a middle part 62 threadedly engaging the rear pipe section 54 of the coupler pipe 50 such that rotation of the sleeve member 60 with respect to the coupler pipe 50 results in axial movement of the rear part 63 of the adjustment sleeve member 60 in the rear portion 113 of the faucet body 11.

Since the sleeve member 60 is rotatable on the coupler pipe 50, the rear part 63 can be threaded on the threaded end portion 901 of the standard pipe. The front pipe section 51 of the coupler pipe 50 is then threaded to the pipe mounting seat 112. The rear pipe section 54 of the coupler pipe 50 is threaded adjustably into the middle part 62 of the sleeve member 60 via the front part 61. Under such condition, the faucet body 11 can be turned with respect to the water pipe 90 until the rear portion 113 of the faucet assembly 11 abuts against the wall 30.

Preferably, a seal ring 55 is disposed in an annular groove 521 formed on the enlarged middle pipe section 52 of the coupler pipe 50 so as to be in sliding contact with the front part 61 of the sleeve member 60, thereby establishing a water seal between the coupler pipe 50 and the sleeve member 60.

Figure 7:
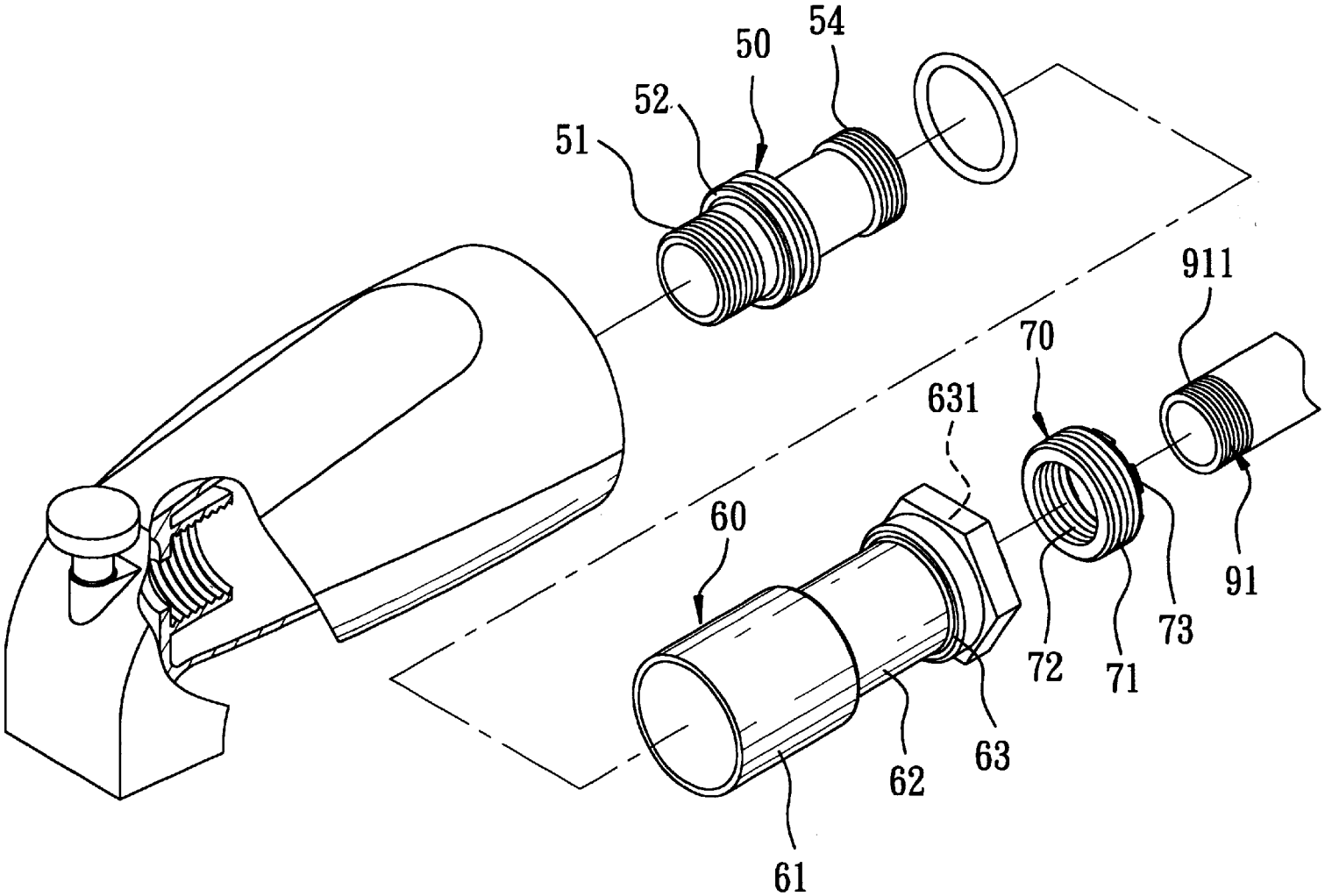
FIG. 7 is an exploded perspective view of the second preferred embodiment of a faucet assembly of the present invention for mounting on a small-diameter standard water pipe with an externally threaded end portion.
Figure 8:
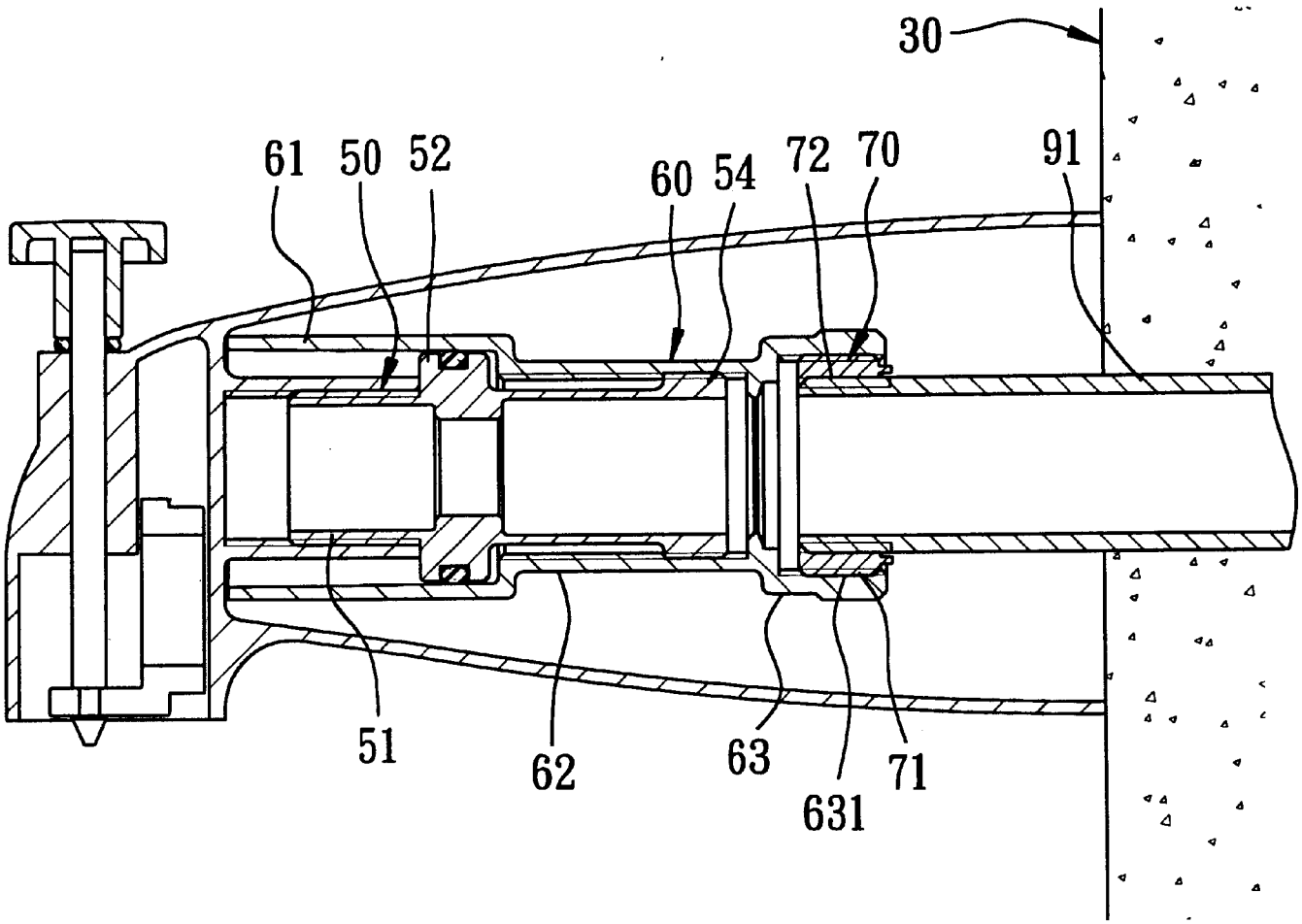
FIG. 8 is a sectional view of the second preferred embodiment when mounted on the threaded end portion of the standard water pipe.

Referring to FIGS. 7 and 8, a second preferred embodiment of the present invention is shown to be adapted for mounting on a small-diameter standard water pipe 91 with an externally threaded end portion 911. Since the structures of the faucet body 11, the coupler pipe 50, and the adjustment sleeve member 60 are similar to those of the first preferred embodiment, a detailed disclosure thereof will be omitted herein for the sake of brevity. An annular coupling member 70 is used to establish connection between the adjustment sleeve member 60 and the water pipe 91. As shown, the coupling member 70 has an outer thread portion 71 disposed within and coupled threadedly with the internally threaded end portion 631 of the rear part 63 of the adjustment sleeve member 60, and an inner thread portion 72 coupled threadedly with the threaded end portion 911 of the standard water pipe 91. Preferably, the coupling member 70 is further provided with a plurality of angularly equidistant protrusions 73 extending axially and rearwardly therefrom for gripping of an operating tool thereon. 5 Mounting of the second preferred embodiment on the water pipe 91 is performed in the same manner as the previous embodiment.

Figure 9:
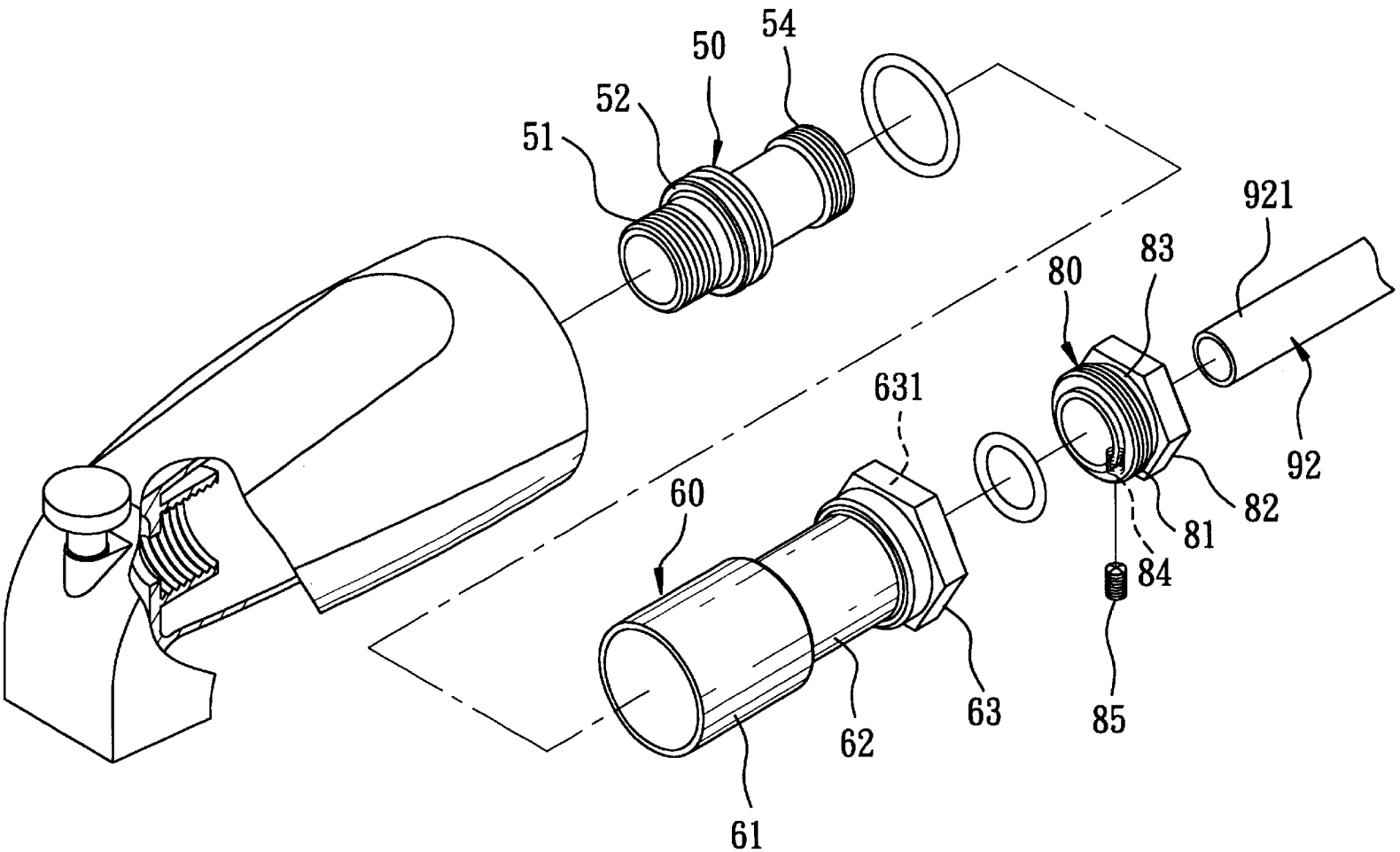
FIG. 9 is an exploded perspective view of the third preferred embodiment of a faucet assembly of the present invention for mounting on a small-diameter standard water pipe with a non-externally threaded end portion.
Figure 10:
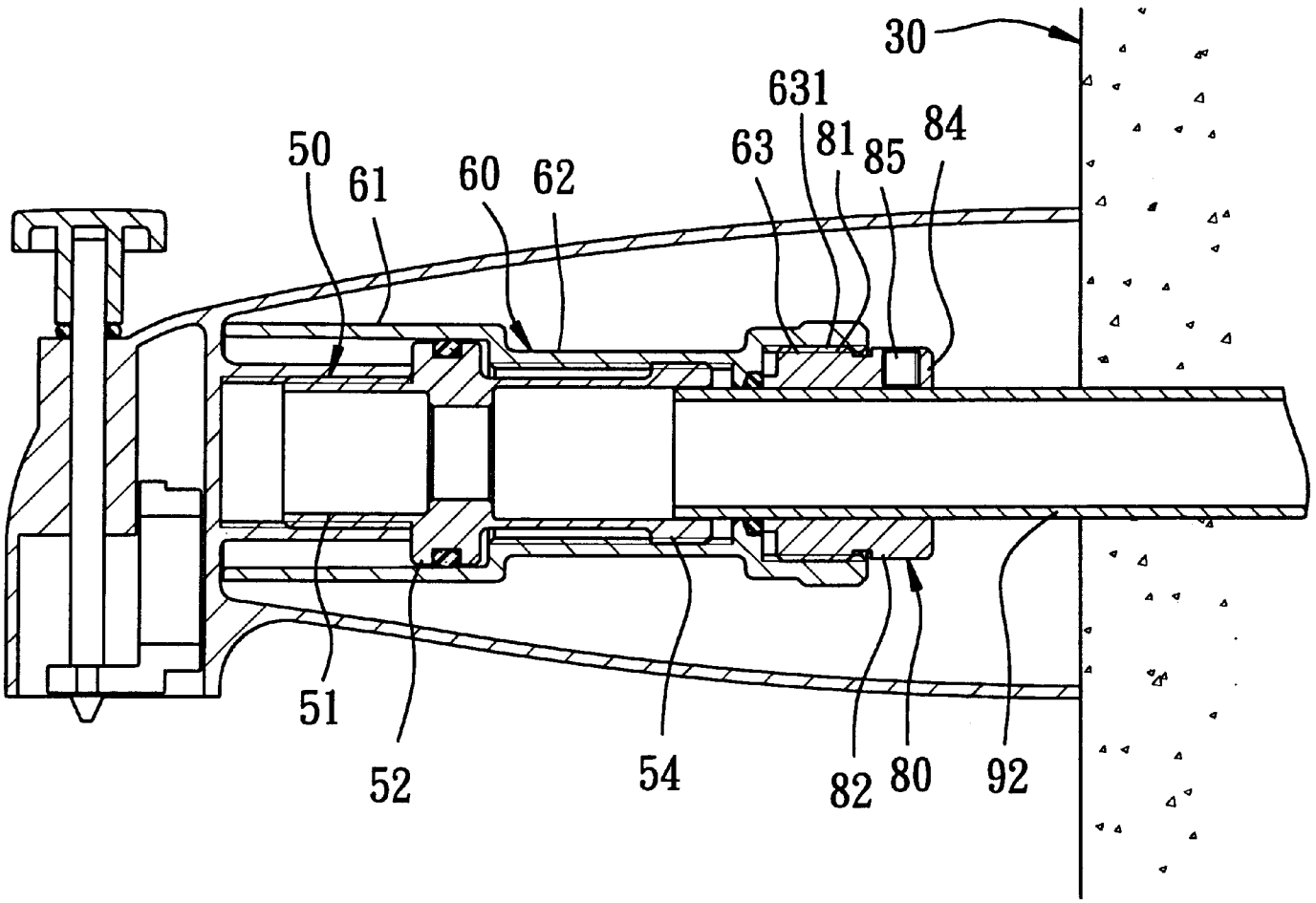
FIG. 10 is a sectional view of the third preferred embodiment when mounted on the non-externally threaded end portion of the small-diameter standard water pipe.

Referring to FIGS. 9 and 10, a third preferred embodiment of the present invention is shown to be adapted for mounting on a standard water pipe 92 with a non-externally threaded end portion 921. An annular coupling member 80 is used to establish connection between the adjustment sleeve member 60 and the water pipe 92. As shown, the coupling member 80 has an externally threaded front portion 81 that is coupled threadedly with the internally threaded end portion 631 of the rear part 63 in the adjustment sleeve member 60 and that is formed with a threaded radial hole 84. A lock bolt 85 is inserted threadedly through the radial hole 84 and presses against the non-externallly threaded end portion 921 of the standard water pipe 92, thereby locking the coupling member 80 on the standard water pipe 92. Preferably, an abutment shoulder 83 is defined between the front and rear portions 81, 82 for abutment with the rear part 63 of the adjustment sleeve member 60.

Since the faucet assembly of the present invention is adapted to be mounted adjustably on standard water pipe, the disadvantages that result from the use of the conventional faucet assemblies can be avoided.

With this invention thus explained, it is apparent that numerous modifications and variations can be made without departing from the scope and spirit of this invention. It is therefore intended that this invention be limited only as indicated by the appended claims.

I claim:

1. A faucet assembly adapted to be mounted on a standard water pipe of predetermined diameter, comprising:

a faucet body including a front portion, a rear portion and an intermediate portion between said front and rear portions, said front portion defining a water passage for flow of water therethrough, and having a water inlet for introducing water into said water passage, a nozzle disposed at a downstream position with respect to the water flow for release of water therefrom, and a pipe mounting seat disposed at an upstream position and in fluid communication with said water inlet;

a coupler pipe of a first predetermined length disposed within said intermediate portion, and having a front pipe section extending into said front portion and connected securely to said pipe mounting seat, a rear pipe section formed with an external thread, and an enlarged middle pipe section between said front and rear pipe sections; and an adjustment sleeve member disposed around said coupler pipe, and having a second predetermined length longer than said first predetermined length and shorter than a total length of said faucet body, said adjustment sleeve member further having a front part enclosing slidably and sealingly said enlarged middle pipe section of said coupler pipe, a rear part adapted to be coupled with the standard water pipe, and a middle part threadedly engaging said rear pipe section of said coupler pipe such that rotation of said sleeve member with respect to said coupler pipe results in axial movement of said rear part of said adjustment sleeve member in said rear portion of said faucet body.

2. The faucet assembly as defined in claim 1, further comprising a seal ring sleeved around said enlarged middle pipe section of said coupler pipe and in sliding contact with said front part of said adjustment sleeve member so as to establish a water seal therebetween.

3. A faucet assembly adapted to be mounted on a standard water pipe with an externally threaded end portion, comprising:

a faucet body including a front portion, a rear portion and an intermediate portion between said front and rear portions, said front portion defining a water passage for flow of water therethrough, and having a water inlet for introducing water into said water passage, a nozzle disposed at a downstream position with respect to the water flow for release of water therefrom, and a pipe mounting seat disposed at an upstream position and in fluid communication with said water inlet;

a coupler pipe of a first predetermined length disposed within said intermediate portion, and having a front pipe section extending into said front portion and connected securely to said pipe mounting seat, a rear pipe section formed with an external thread, and an enlarged middle pipe section between said front and rear pipe sections; and an adjustment sleeve member disposed around said coupler pipe, and having a second predetermined length longer than said first predetermined length and shorter than a total length of said faucet body, said adjustment sleeve member further having a front part enclosing slidably and sealingly said enlarged middle pipe section of said coupler pipe, a rear part with an internally threaded end portion adapted to be coupled threadedly on the externally threaded end portion of the standard water pipe, and a middle part threadedly engaging said rear pipe section of said coupler pipe such that rotation of said sleeve member with respect to said coupler pipe results in axial movement of said rear part of said adjustment sleeve member in said rear portion of said faucet body.

4. A faucet assembly adapted to be mounted on a standard water pipe with an externally threaded end portion, comprising:

a faucet body including a front portion, a rear portion and an intermediate portion between said front and rear portions, said front portion defining a water passage for flow of water therethrough, and having an water inlet for introducing water into said water passage, a nozzle disposed at a downstream position with respect to the water flow for release of water therefrom, and a pipe mounting seat disposed at an upstream position and in fluid communication with said water inlet;

a coupler pipe of a first predetermined length disposed within said intermediate portion, and having a front pipe section extending into said front portion and connected securely to said pipe mounting seat, a rear pipe section formed with an external thread, and an enlarged middle pipe section between said front and rear pipe sections; and an adjustment sleeve member disposed around said coupler pipe, and having a second predetermined length longer than said first predetermined length and shorter than a total length of said faucet body, said adjustment sleeve member further having a rear part with an internally threaded end portion, a front part enclosing slidably and sealingly said enlarged middle pipe section of said coupler pipe, a middle part interposed between said front and rear parts and threadedly engaging said rear pipe section of said coupler pipe such that rotation of said adjustment sleeve member with respect to said coupler pipe results in axial movement of said rear part of said adjustment sleeve member in said rear portion of said faucet body; and an annular coupling member having an outer thread portion disposed within and coupled threadedly with said internally threaded end portion of said rear part of said adjustment sleeve member, and an inner thread portion adapted to be coupled threadedly with the externally threaded end portion of the standard water pipe.

5. The faucet assembly as defined in claim 4, wherein said annular coupling member is further provided with a plurality of angularly equidistant protrusions extending axially and rearwardly therefrom for gripping of an operating tool thereon.

6. A faucet assembly adapted to be mounted on a standard water pipe with a non-externally threaded end portion, comprising:

a faucet body including a front portion, a rear portion and an intermediate portion between said front and rear portions, said front portion defining a water passage for flow of water therethrough, and having a water inlet for introducing water into said water passage, a nozzle disposed at a downstream position with respect to the water flow for release of water therefrom, and a pipe mounting seat disposed at an upstream position and in fluid communication with said water inlet;

a coupler pipe of a first predetermined length disposed within said intermediate portion, and having a front pipe section extending into said front portion and connected securely to said pipe mounting seat, a rear pipe section formed with external thread, and an enlarged middle pipe section between said front and rear pipe sections; and an adjustment sleeve member disposed around said coupler pipe and having a second predetermined length longer greater than said first predetermined length and shorter than a total length of said faucet body, said adjustment sleeve member further having a rear part with an internally threaded end portion, a front part enclosing slidably and sealingly said enlarged middle pipe section of said coupler pipe, a middle part interposed between said front and rear parts and threadedly engaging said rear pipe section of said coupler pipe such that rotation of said sleeve member with respect to said coupler pipe results in axial movement of said rear part of said adjustment sleeve member in said rear portion of said faucet body;

an annular coupling member adapted to be sleeved over the non-externally threaded end portion of the standard water pipe, and having an externally threaded front portion that is coupled threadedly with said internally threaded end portion of said rear part of said adjustment sleeve member and that is formed with a threaded radial hole; and a lock bolt inserted threadedly through said radial hole and adapted to press against the non-externallly threaded end portion of the standard water pipe, thereby locking said coupling member on the standard water pipe.

* * * * *